US006000300A

United States Patent [19]

Plamondon

[11] Patent Number: 6,000,300

[45] **Date of Patent: *Dec. 14, 1999**

[54] ADJUSTABLE SOCKET WRENCH

[76] Inventor: Walter J. Plamondon, 416 Burroughs St., Flint, Mich. 48507

[ * ] Notice: This patent issued on a continued prosecution application filed under 37 CFR 1.53(d), and is subject to the twenty year patent term provisions of 35 U.S.C. 154(a)(2).

[21] Appl. No.: 08/735,703

[22] Filed: Oct. 23, 1996

[51] Int. Cl.[6] ..... B25B 13/32

[52] U.S. Cl. ..... 81/90.2; 81/115; 279/71

[58] Field of Search ..... 81/90.2, 90.3, 81/112–115; 279/71, 81, 50, 51

[56] References Cited

U.S. PATENT DOCUMENTS

| | | | |
|---|---|---|---|
| 269,902 | 1/1883 | Wheeler | 81/115 |
| 279,896 | 6/1883 | Wheeler | 81/115 |
| 1,477,440 | 12/1923 | Grier, Jr. | 279/71 X |
| 2,438,797 | 3/1948 | Bagge | 81/112 X |
| 2,476,874 | 7/1949 | Johansson | 81/112 X |
| 2,701,724 | 2/1955 | Harris | 279/71 |
| 3,373,639 | 3/1968 | Van Dalen et al. | 81/112 |
| 3,724,299 | 4/1973 | Nelson . | |
| 4,213,355 | 7/1980 | Colvin . | |
| 4,235,134 | 11/1980 | McLendon . | |
| 4,366,733 | 1/1983 | Colvin . | |
| 4,378,714 | 4/1983 | Colvin . | |
| 4,520,698 | 6/1985 | Martinmaas . | |
| 4,608,887 | 9/1986 | Colvin . | |
| 4,663,999 | 5/1987 | Colvin . | |
| 4,757,729 | 7/1988 | Martinmaas . | |
| 4,884,480 | 12/1989 | Briese . | |
| 4,892,016 | 1/1990 | Anderson . | |
| 4,911,040 | 3/1990 | Kim . | |
| 5,207,129 | 5/1993 | Fossella . | |
| 5,207,130 | 5/1993 | Payne | 81/90.2 |

FOREIGN PATENT DOCUMENTS

| | | | |
|---|---|---|---|
| 921522 | 3/1963 | United Kingdom | 279/71 |

*Primary Examiner*—D. S. Meislin
*Attorney, Agent, or Firm*—Gifford, Krass, Groh, Sprinkle, Anderson & Citkowski, P.C.

[57] ABSTRACT

An adjustable socket wrench has only two components, namely, a collet driver with movable jaws and a circumscribing adjustable sleeve. Positive detent positioning of the fastener engaging jaws is obtained by rotation of the adjusting sleeve which radially moves the jaws inwardly or outwardly without axial movement of any parts.

4 Claims, 2 Drawing Sheets

ADJUSTABLE SOCKET WRENCH

BACKGROUND OF THE INVENTION

I. Field of the Invention

This invention relates to socket wrenches, and, more particularly, this invention relates to adjustable socket wrenches.

II. State of the Art

There are a variety of adjustable socket wrench designs which engage two or more sizes of hex (hexagon shaped) headed nut or bolt fasteners. These adjustable socket wrenches require the use of more than three components and in some cases many complicated components, to effect an axial movement of a cam or cam follower element to radially displace the wrench jaws or operating arms. Usually the rotary motion of an adjusting sleeve is converted to an axial movement of a cam element to effect a radial movement of the jaws. Often there are no positive stop positions for a given size, but the user must relie on the alignment of an index mark with a scale to approximate the desired size. At best these wrenches may offer a positive stop at a fully opened or fully closed position with reliance on a calibration or scale reading for any intermediate sizes. This not only results in inaccuracies in the size setting, but also can allow slippage or opening of the jaws during use.

SUMMARY OF THE INVENTION

The present invention provides an adjustable socket wrench having only two separate components, an inner driver and an outer rotatable adjusting sleeve, which provides a plurality of sizes, preferably three, with positive detent positioning at each size.

Only four wrenches are needed to cover a most popular range of sizes in the English system between 5/16" and 1" in 1/16" increments; a first wrench would cover 5/16, 3/8 and 7/16; a second wrench would cover 1/2, 9/16 and 5/8; a third wrench would cover 11/16, 3/4 and 13/16; and a fourth wrench would cover 7/8, 15/16 and 1". Moreover, the socket wrench of this invention is designed for use with a standard ratchet handle with a square shank drive fitting a square socket in the wrench driver.

The adjustable socket wrench according to the invention includes a longitudinally extending cylindrical rotatable driver having an axially aligned drive socket at one end and a plurality of circumferentially spaced, axially extending jaws at its other end, each of the jaws having an inwardly facing fastener engaging surface, and each of the jaws being spring biased outwardly. Each of the jaws also has a radially outward projecting detent projection or cam follower adjacent its free end. A rotatable adjusting sleeve is arranged to circumscribe the driver. The adjusting sleeve has a circumferential cam track which will line up or be adjacent to the detent projections. The cam track has a plurality of circumferentially spaced groups of serially arranged detent recesses. Each recess of each group has a different predetermined radial position, and one of the groups will be diametrically opposed to each detent projection of each jaw. When the sleeve is rotated, each of the detent projections will sequentially engage a first one of the detent recesses at a first predetermined radial position and then engage a second one of the detent recesses at a second predetermined radial position thereby radially moving the jaws against their spring bias so that the fastener engaging surfaces are adapted to engage axially extending tool engaging surfaces of a fastener of a first size and then a fastener of a second size.

In a preferred form of the invention each group contains three detent recesses for accommodating fasteners of three different sizes as indicated above. Likewise in a preferred embodiment, the driver has six jaws with the surfaces adapted to engage hexagonal shaped fasteners.

In a preferred embodiment of the invention, the driver is constructed as a collet with jaws being integral with the shank portion containing the drive socket. This will automatically create the radially outward directed spring bias. For practicality in manufacture, the adjusting sleeve is constructed with a base tube having a reduced outside diameter at one of its ends with an end cap slid over the reduced outside diameter and permanently affixed to the base tube. This allows the end cap to be machined or otherwise formed with the cam track before permanently affixing it to the base tube. The detent projections on the jaws extend axially having opposed ends which are confined between an end face of the base tube and a radially extending shoulder of the end cap when the end cap has been permanently affixed to the base tube with the jaws of the driver located inside the rotatable adjusting sleeve.

There can be other obvious modifications which will become apparent from the following detailed description as for example changing from a six jaw unit to use two, four or eight jaws to grip square headed and octagonally headed fasteners.

DRAWING

The advantages of the present invention will be more apparent from the following detailed description when considered in connection with the accompanying drawing wherein.

Figure 3:
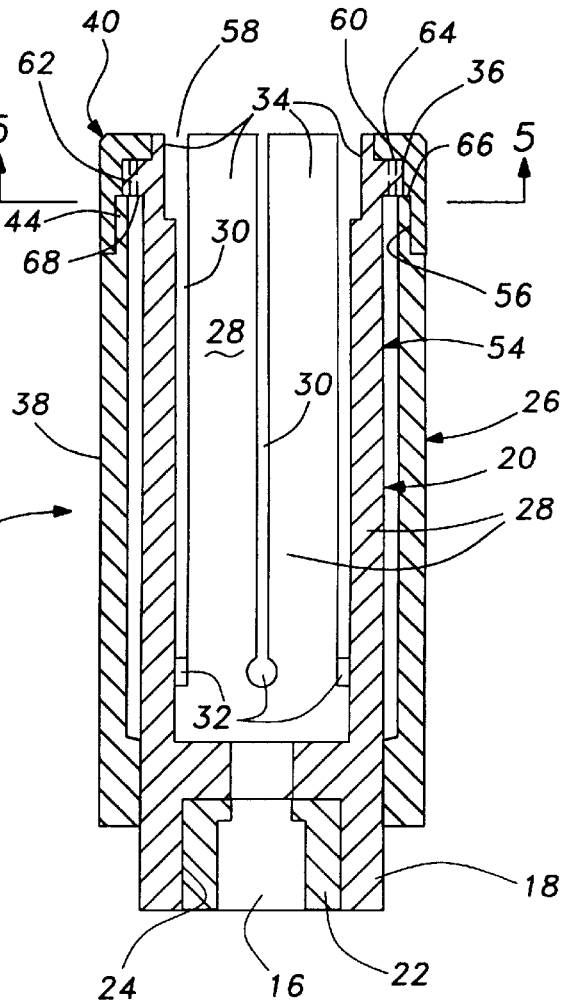
FIG. 3 is a cross-sectioned elevational view of the assembled wrench of FIGS. 1 and 2.
Figure 2:
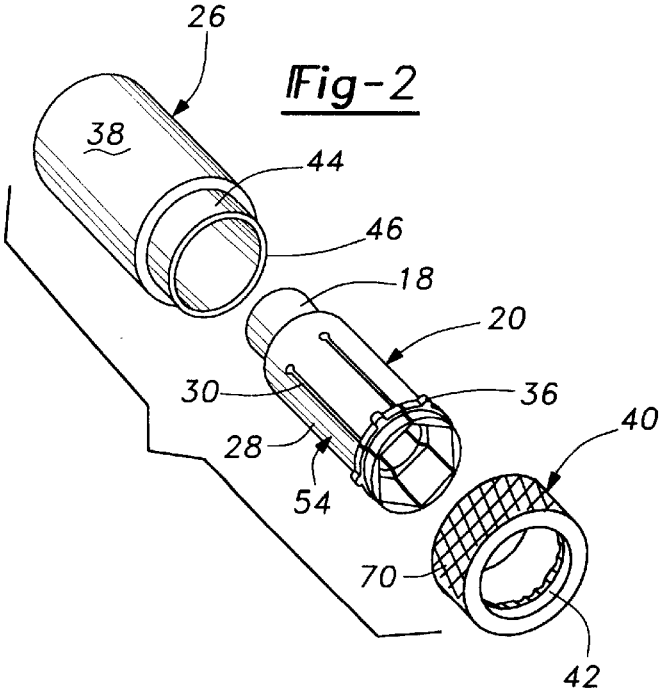
FIG. 2 is an exploded perspective view showing the wrench assembly of the collet driver to the base tube and end cap of the adjusting sleeve.
Figure 5:
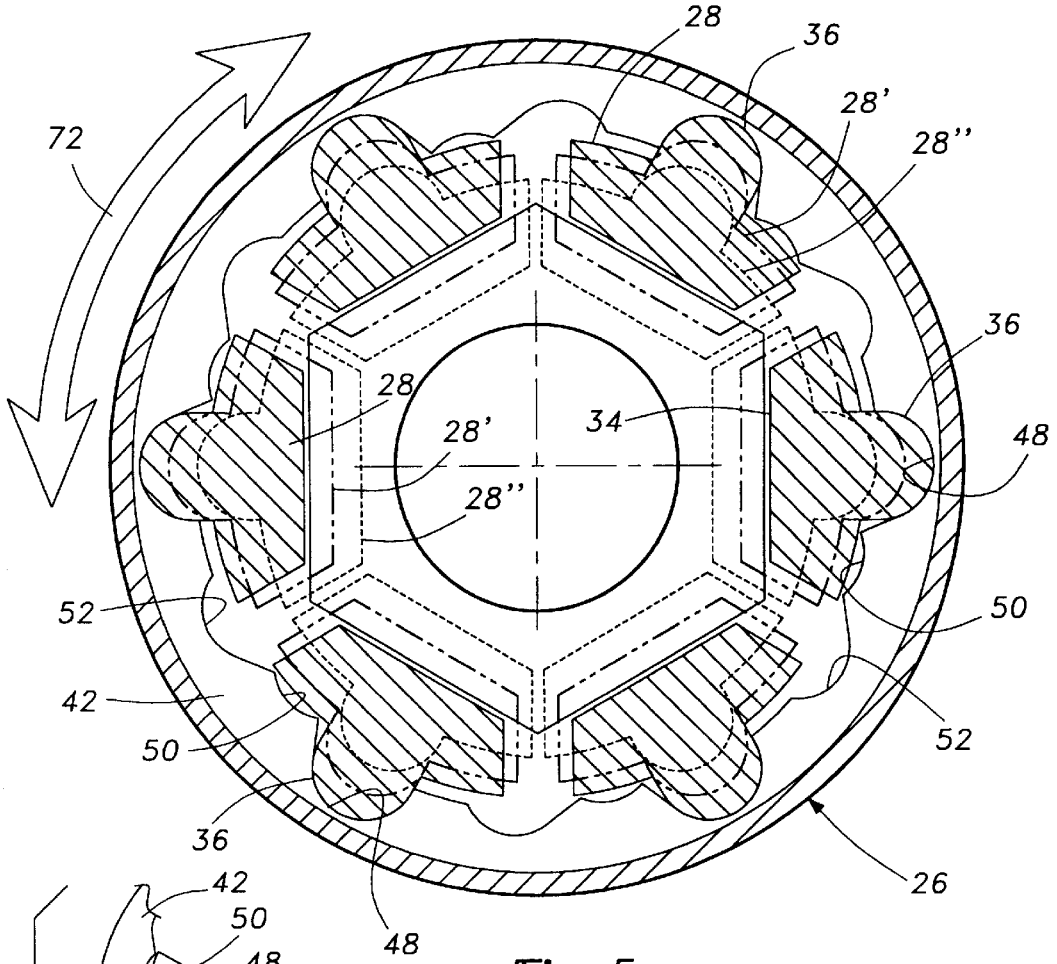
Figure 6:
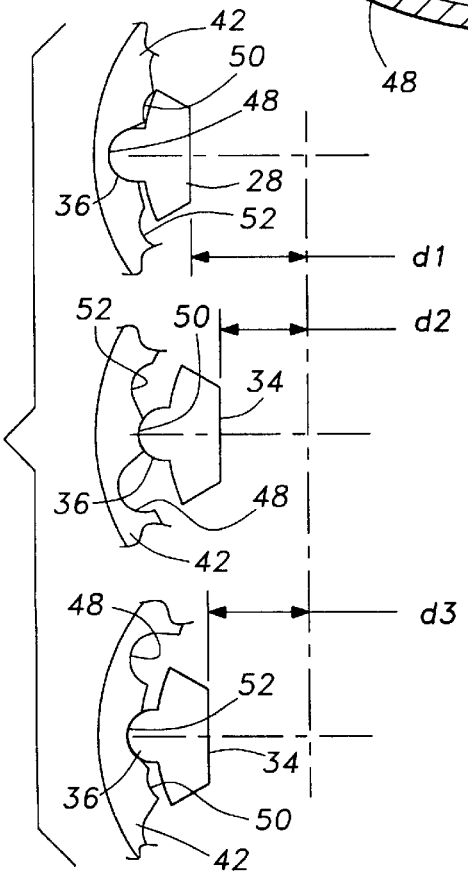

FIG. 5 is a cross-sectional view taken along line 5—5 of FIG. 3 showing, in solid line and two phantom lines, three jaw positions; and FIG. 6 is an end view of a portion of the adjusting sleeve cam track as it is rotated in either direction of the arrow in FIG. 5 to engage the detent projection on one of the jaws with one of three different cam track detent recesses to accommodate three different fastener diameters.

DETAILED DESCRIPTION OF THE PRESENTLY PREFERRED EMBODIMENT OF THE INVENTION

Figure 1:
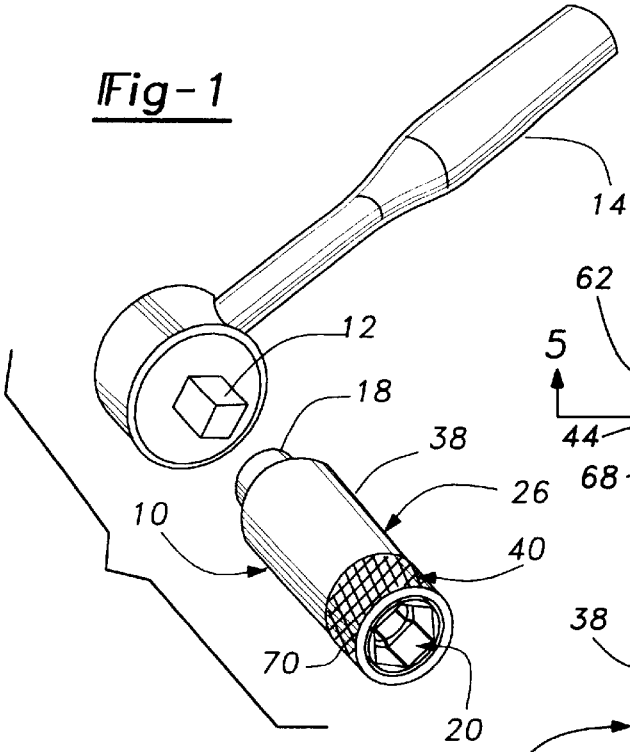
FIG. 1 is a perspective view showing a conventional ratchet drive handle with its square driving shank positioned to be received in the drive socket of the adjustable socket wrench of the present invention.
Figure 4:
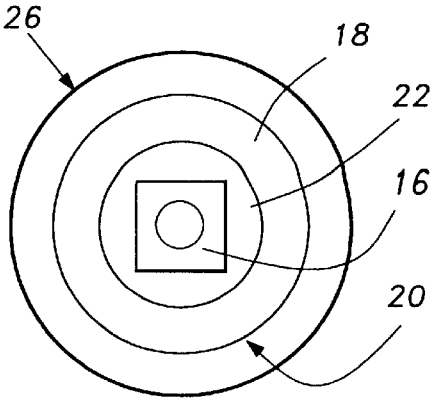
FIG. 4 is an end view at the drive socket end of the wrench.

Referring to FIG. 1, the adjustable socket wrench 10 of this invention is shown in position to be engaged by square drive 12 of a standard ratchet handle 14 with the drive projecting into the square socket 16 of the shank portion 18 of the cylindrical driver 20; see also FIGS. 3 and 4. As best seen in FIG. 3, the socket 16 can be in an insert 22, force-fitted or otherwise bonded in bore 24 of shank portion 18 or it can be directly machined or molded in the shank portion 18 of the driver 20.

The socket wrench 10 itself has two components, the generally cylindrical longitudinally extending driver and an overlying adjusting sleeve 26 which is rotatable with respect to the driver 20 but is axially fixed with respect to the driver.

The driver 20 has the socket 16 at its shank end 18 and a plurality of circumferentially spaced, longitudinally extending arms or jaws 28 at its other collet end 54. In the illustrated wrench for hex head fasteners, there arc six equally spaced jaws 28, and these jaws are preferably formed integrally with the shank portion 18 as a collet. Longitudinal or axial slots 30 with the inner end relief apertures 32 define the jaws 28 which will have an inherent radially outward spring bias. The inside diameters of the jaws 28 are arcuate with chordal planar fastener engaging faces or surfaces 34 at their free ends. Each of the jaws 30 has an outward projecting, axial extending detent projection 36 adjacent its free end and facing in the opposite direction from planar surface 34.

The adjusting sleeve 26 is constructed with two pieces, namely, a base tube 38 and an open ended end cap 40 to facilitate the molding, machining or casting of a cam track 42 in the cap and to facilitate the assembly of the adjusting sleeve to the driver collet 20. The base tube has a reduced outside diameter section 44 at one end terminating in an end face 46. The end cap 40 has a larger open end 56 to receive the reduced outside diameter portion of the base tube 38 and a smaller open end 58 defined by end flange 60 receiving the ends of collet jaws 28.

The cam track 42, as best seen in FIG. 5, is formed with circumferentially repeating groups or sequences of detent recesses of different radial depths. In the preferred illustrated embodiment, six jaws are used to simultaneously engage the tool engaging surfaces of a hex head fastener. Three different sizes of hex head fasteners can be engaged at three different radial jaw positions accomplished by engagement of the jaw detent projection 36 with detent recesses of three different depths. Referring to FIGS. 5 and 6, cam detent recess 48 is the deepest for engaging the largest size, d1, fastener; cam detent recess 50 is the shallowest for engaging the smallest size, d2, fastener, and cam detent recess 52 is an intermediate depth between recesses 48 and 50 to engage an intermediate size, d3, fastener.

When the collet 54 is in its relaxed position, with no inward force being applied to the jaws 28 against the spring bias, the jaws 28 will be in their fully opened position, as shown in FIGS. 3 and 5 with detent projections 36 engaging the deepest detent recesses 48 in cam track 42, as best seen in FIG. 5 and the top portion of FIG. 6, to engage a d1 size fastener between the jaw faces 34. The socket wrench can be easily assembled in this relaxed position of the collet 54 by inserting collet jaws 28 of driver 20 into the end cap 40 with the detent projections 36 of the jaws 28 in detent recesses 48 of the cam track 42 with the inside shoulder surface 62 of cap end flange 60 acting as an axial stop against the outer ends 64 of detent projections 36. The base tube 38 of adjusting sleeve 26 is then slid over the shank portion 18 of the driver 20 with the reduced diameter section 44 received in the larger open end 56 of end cap 40 with the end face 66 of base tube 38 acting as an axial stop against the inner ends 68 of detent projections 36. The fit between the reduced diameter section 44 of the base tube 38 and the open end 56 of the end cap 40 may be a force fit or shrink fit to permanently affix the cap 40 to the tube 38 or the cap can be welded, brazed or otherwise bonded to the base tube.

The outer surface of the end cap 40 can be knurled as shown at 70 to serve as a finger grip for rotating the adjusting sleeve 26. As indicated by the arrow 72 in FIG. 5, the adjusting sleeve 26 can be rotated in either direction to change the wrench size while the shank portion 18 of the driver is held stationary, usually with the help of drive 12 of the ratchet handle 14 engaging socket 16 of the wrench 10. For example, counterclockwise rotation of the adjusting sleeve 26 with its cam track 42 will cause the jaw detent projections 36 to be moved out of the largest size detent recesses 48 into the smallest size detent recesses 50 as seen by the jaw positions 28" in FIG. 5 and the change in position from the d1 position at the top of FIG. 6 to the d2 position shown in the middle of FIG. 6. A further counterclockwise rotation of the adjusting sleeve 26 will cause the jaw detent projections 36 to be moved out of the smallest size detent recesses 50 of the cam track 42 into the intermediate size detent recesses 52 as seen by the jaw position 28' in FIG. 5 and the change in position from the d2 position shown in the middle of FIG. 6 to the d3 position shown at the bottom of FIG. 6.

I claim:

1. An adjustable socket wrench comprising:

a longitudinally extending cylindrical rotatable driver having an axially aligned drive socket at one end and a plurality of circumferentially spaced, axially extending jaws at its other end, each of said jaws having an inwardly facing fastener engaging surface, and each of said jaws being spring biased outwardly;

a radially outward projecting detent projection on each of said jaws adjacent a free end of each jaw;

a rotatable adjusting sleeve circumscribing said driver and having a circumferential cam track adjacent said detent projections, said adjusting sleeve being constructed with a base tube having a reduced outside diameter at one of its ends with an end cap slid over said reduced outside diameter and affixed to said base tube, said end cap containing said cam track, said cam track having a plurality of circumferentially spaced groups of serially arranged detent recesses, each recess of each group being at a different predetermined radial position, and one of said groups being diametrically opposed to each detent projection;

said detent projections extending axially and having opposed ends configured between an end face of said base tube at one end and a radially extending shoulder of said end cap; and wherein as said sleeve is rotated, each of said detent projections will sequentially engage a first one of said detent recesses at a first predetermined radial position and then engage a second one of said detent recesses at a second predetermined radial position thereby radially moving said jaws against said spring bias so that said fastener engaging surfaces are adapted to engage axially extending tool engaging surfaces of a fastener of a first size and a fastener of a second size.

2. The wrench according to claim 1 wherein each group contains three detent recesses for accommodating fasteners of three different sizes.

3. The wrench according to claim 1 wherein said driver has six jaws with said surfaces adapted to engage hexagonal shaped fasteners.

4. The wrench according to claim 1 wherein said driver is constructed as a collet with said jaws being integral with a shank portion containing said drive socket.

* * * * *